US005335835A

United States Patent [19]

Hogan

[11] Patent Number: 5,335,835

[45] Date of Patent: Aug. 9, 1994

[54] SKI EQUIPMENT CARRYING STRAP

[76] Inventor: Larry E. Hogan, 9202 Glenbury, Houston, Tex. 77037

[21] Appl. No.: 56,732

[22] Filed: May 4, 1993

[51] Int. Cl.[5] ..... A45C 13/20; B65D 85/18

[52] U.S. Cl. ..... 224/257; 224/917; 224/268; 280/814; 294/147

[58] Field of Search ..... 224/917, 901, 257, 268; 294/147; 36/132; 280/814

[56] References Cited

U.S. PATENT DOCUMENTS

| | | | |
|---|---|---|---|
| 2,530,695 | 11/1950 | Helmert | 294/147 X |
| 3,278,097 | 8/1965 | Duckworth . | |
| 3,960,302 | 6/1976 | Mazzoni, Jr. | 224/917 X |
| 4,002,277 | 1/1977 | Westerholm | 294/147 |
| 4,114,838 | 9/1978 | Knauf . | |
| 4,221,314 | 9/1980 | Baker, Jr. | 280/814 X |
| 4,242,813 | 1/1981 | Quance . | |
| 4,456,284 | 6/1984 | Saka | 280/814 X |
| 4,461,506 | 7/1984 | Crump . | |
| 4,463,885 | 8/1984 | Ball . | |
| 4,658,999 | 4/1987 | Hilty | 224/202 |
| 4,729,591 | 3/1988 | Scalise . | |
| 4,790,462 | 12/1988 | Kanaguchi | 224/917 X |
| 4,856,689 | 8/1989 | Shore . | |
| 4,863,083 | 9/1989 | Chen | 224/226 |
| 4,903,875 | 2/1990 | Smart et al. | 224/257 X |

*Primary Examiner*—Ernest G. Cusick
*Attorney, Agent, or Firm*—Vaden, Eickenroht, Thompson, Boulware, & Feather

[57] ABSTRACT

A carrying strap for ski equipment is disclosed. The carrying strap includes a first strap member having second and third strap members affixed transversely at either end thereof. Each of the second and third strap members include means for connecting the respective ends thereof together. A snap hook is affixed at either end of the first strap member. In use, the ends of the second and third strap members are connected together to loop around the skis and ski poles to secure them for carrying while the ski boots are clipped to the ends of the first strap member with the snap hooks.

8 Claims, 1 Drawing Sheet

FIG. 1
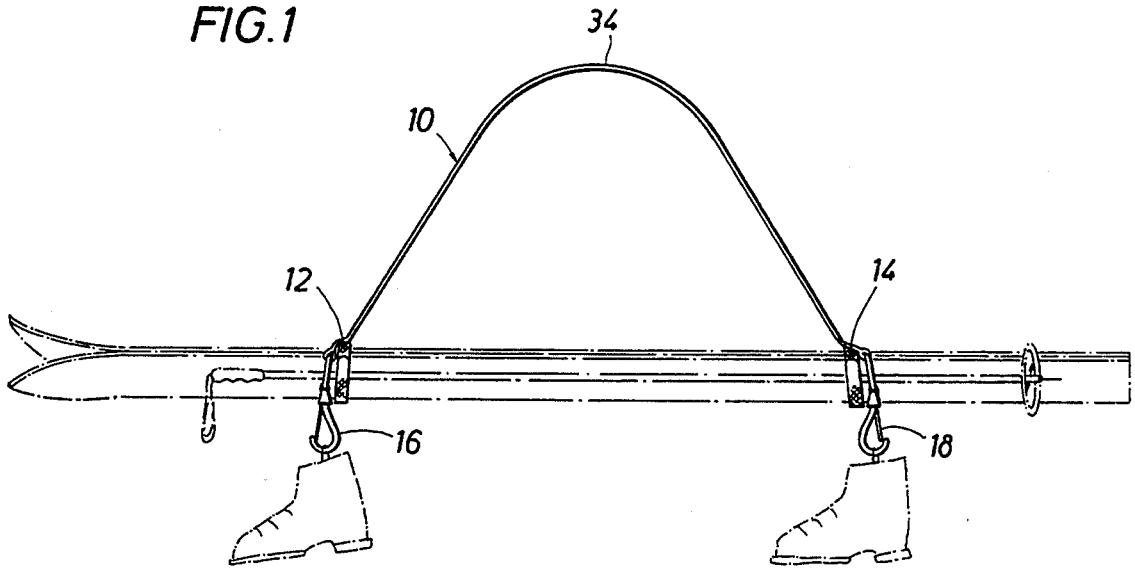
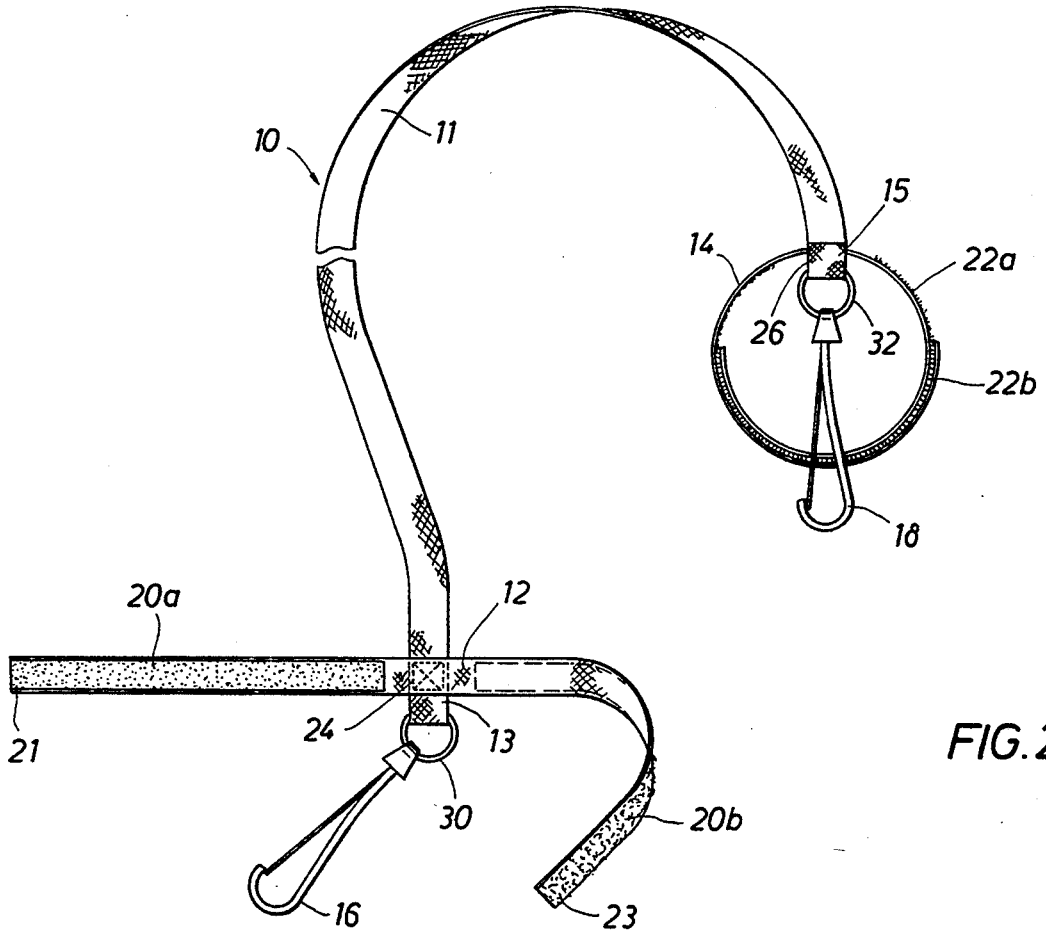
FIG. 2

SKI EQUIPMENT CARRYING STRAP

BACKGROUND OF THE INVENTION

1. Field of the Invention

This invention pertains to an apparatus for carrying ski equipment and, more particularly, for carrying skis, ski poles, and ski boots at the same time.

2. Description of the Prior Art

One of the perpetual difficulties and inconveniences in skiing is the need for carrying all of one's ski equipment at the same time. This is generally true regardless of whether one is a recreational or occupational skier, since it is virtually certain that at some point one will be forced to carry this equipment. There have been many attempts over the years to develop an apparatus for conveniently carrying skis, ski poles, and ski boots simultaneously with ease and comfort. To date, nobody has succeeded.

Several prior art attempts have employed "carrying straps" for carrying ski poles and skis. This approach can be seen in U.S. Pat. Nos. 4,729,591 issued to Scalise; 4,221,314 issued to Baker, Jr.; 4,463,885 issued to Ball et al.; 4,114,838 issued to Knauf; and 3,278,097 issued to Duckworth. The patent issued to Scalise is convertible for carrying ski boots instead of skis and ski poles. U.S. Pat. No. 4,242,813 issued to Quance discloses a carrying strap for carrying ski boots only.

U.S. Pat. No. 4,461,506 discloses an apparatus for carrying an assortment of ski equipment, including skis, ski poles, and boots at the same time. The carrier is constructed of a rigid material, has many moving parts, and would be difficult to use with gloved hands or in cold weather with bare hands. Although it purports to carry skis, ski poles, and boots simultaneously, it is altogether unsatisfactory because of its nature and construction.

Only U.S. Pat. No. 4,856,689 issued to Shore discloses an apparatus for carrying skis, ski poles, and ski boots simultaneously where the apparatus is not rigid, does not contain multiple moving parts, and is in the flexible nature of a strap. The two ends of a lanyard extend from a leather handgrip and are looped around the skis and ski poles for carrying them. Another lanyard extends downwardly from the handgrip to secure the boots so that the boots rest on the skis directly under the user's hand. However, this position virtually guarantees that the boots will always be perfectly located to interfere with the user's ability to walk and carry the equipment at the same time.

It is therefore a feature of the present invention that it enables a skier to carry skis, ski poles, and ski boots simultaneously.

It is furthermore a feature of the invention that the apparatus is of a flexible nature such as a carrying strap.

It is a still further feature of the invention that it positions the boots when they are carried so that they do not interfere with the user's ability to carry the equipment and walk at the same time.

SUMMARY OF THE INVENTION

The invention is a strap for carrying ski equipment, including skis, ski boots, and ski poles simultaneously, comprised of a first strap member having second and third strap members affixed transversely at either end thereof. Each of the second and third strap members include means for connecting the ends thereof together, respectively. Also, at either end of the first strap member are means for clipping ski boots thereto. In use, each of the second and third strap members are wrapped around the skis and ski poles to secure them for carrying while the ski boots are clipped to the ends of the first strap member.

DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only a preferred embodiment of the invention and are not to be considered limiting of its scope as the invention will admit to other equally effective embodiments.

In the drawings:

FIG. 1 is an illustration of the invention in its preferred embodiment in use; and FIG. 2 is an illustration of the preferred embodiment of FIG. 1 more clearly illustrating the details of construction.

DESCRIPTION OF THE PREFERRED EMBODIMENT

FIG. 1 illustrates the present invention, a carrying strap generally designated 10, during use while FIG. 2 illustrates the details of construction for strap 10. Strap 10 is comprised of first strap member 11 having second strap member 12 affixed at first strap end 13 and third strap member 14 affixed at second strap end 15. First strap member 11 also has first snap hook 16 and second snap hook 18 affixed to first strap end 13 and second strap end 15, respectively.

First strap member 11, second strap member 12, and third strap member 14 in the preferred embodiment are all constructed of approximately ½" to 1" nylon webbing. However, other similarly flexible materials may be used provided they are sufficiently dimensioned so as not to cut into the hand of the user while fitting easily in the palm of the hand. Alternative materials must also be sufficiently strong to bear the weight of carried equipment.

One advantage to nylon webbing is that it facilitates affixation of various elements to first strap 11. For instance, as shown in FIG. 2, second strap member 12 is simply sewn to first strap member 11 at point 24 on first strap end 13 using a square and cross stitching pattern. Furthermore, first clip 16 and second clip 18 are affixed at first strap end 13 and second strap end 15, respectively, by looping the nylon webbing through eyes 30 and 32 of snap hooks 16 and 18 and stitching down the end of the nylon webbing.

Second strap member 12 and third strap member 14 are adapted to be looped around skis and ski poles. Again referring to FIG. 2, second strap member 12 has VELCRO® hook-and-loop elements **20*a* and 20*b* affixed to third strap end 21 and fourth strap end 23, respectively. Third strap member 14 is similarly constructed, and fifth strap end 25 and sixth strap end 26 are shown connected by VELCRO® hook-and-loop elements 22*a* and 22*b* as they would be to form a loop around a pair of skis and ski poles as shown in FIG. 1**.

It is important that first snap hook 16 and second snap hook 18 be mounted at or near first strap end 13 and second strap end 15, respectively, for two reasons. First, this positions the ski boots out of the way of the user as shown in FIG. 1. Second, the load is evenly balanced by having the same or similar weights on both ends of first strap member 11 when grasped in the middle thereof at point 34 to facilitate carrying all of the equipment simultaneously.

The length of first strap element 11, second strap element 12, and third strap element 14 is necessarily dictated in large part by function. In the preferred embodiment, first strap element 11 is approximately 71.3 cm (28⅜") long while second strap element 12, and third strap element 14 are approximately 47.6 cm (19⅛") long. However, second strap element 12 an third strap element 14 need only be sufficiently long so that when the ends thereof are connected together the resulting loop will encircle a pair of skis and ski poles. First strap element 11 needs to be sufficiently long that when carrying ski equipment, either (1) the ski boots do not drag the ground when carried by hand, or (2) the skis ride at approximately waist level when slung over the shoulder.

From the foregoing it will be seen that this invention is one well adapted to attain all of the ends and objects previously set forth, together with other advantages which are obvious from the teachings herein and which are inherent to the apparatus. For instance, first and second snap hooks 16 and 18 can also be equipped with rotatable eyes instead of static eyes 30 and 32 to allow ski boots to freely rotate thereon. Still other modifications and variations will become apparent to those in the art having the benefits of the teachings herein.

As many possible embodiments may be made of the invention without departing from the scope thereof, it is to be understood that all matter herein set forth or shown in the accompanying drawings is to be interpreted as illustrative and not in a limiting sense. Furthermore, it will be understood that some features and subcombinations are of utility and may be employed without reference to other features and subcombinations. This is contemplated by and is within the scope and spirit of the claimed invention.

What is claimed is:

1. A strap for carrying ski equipment, including skis, ski boots, and ski poles, the strap comprising:

a first strap member having first and second strap ends;

a second strap member having third and fourth strap ends, the second strap member affixed transversely relative to the first strap member at the first strap end;

first means for connecting the third and fourth strap ends to form a loop for encircling a pair of skis and a pair of ski poles at a first point;

a third strap member having fifth and sixth strap ends, the third strap member affixed transversely relative to the first strap member at the second strap end;

second means for connecting the fifth and sixth strap ends to form a loop for encircling the pair of skis and the pair of ski poles at a second point;

first means for clipping a ski boot thereto affixed to the first strap end such that the first strap end terminates with the first clipping means; and second means for clipping a ski boot thereto affixed to the second strap end such that the second end terminates with the second clipping means.

2. The strap of claim 1, wherein any one of the first and second connecting means is comprised of hook-and-loop elements.

3. The strap of claim 1, wherein any one of the first and second clipping means is a snap hook.

4. The strap of claim 3, wherein the snap hook has a static eye.

5. The strap of claim 1, wherein the first strap member does not have a handle affixed thereto.

6. The strap of claim 1, wherein any one of the second and third strap members is affixed to the first strap member by sewing.

7. The strap of claim 1, wherein any one of the first and second clipping means is affixed to the first strap member by sewing.

8. The strap of claim 1, wherein any one of the first strap member, the second strap member, and the third strap member is constructed of nylon webbing.

* * * * *